US008505418B1

(12) United States Patent
Chiang

(10) Patent No.: US 8,505,418 B1
(45) Date of Patent: Aug. 13, 2013

(54) TOOL EXTENSION

(76) Inventor: Wen Hung Chiang, Taichung (TW)

( * ) Notice: Subject to any disclaimer, the term of this patent is extended or adjusted under 35 U.S.C. 154(b) by 0 days.

(21) Appl. No.: 13/588,057

(22) Filed: Aug. 17, 2012

(51) Int. Cl.

| | |
|---|---|
| ***B25B 23/16*** | (2006.01) |
| ***B25B 13/00*** | (2006.01) |
| ***B25B 23/00*** | (2006.01) |
| ***B25G 1/00*** | (2006.01) |

(52) U.S. Cl.
USPC ..... 81/177.2; 81/177.75; 81/124.2; 81/438

(58) Field of Classification Search
USPC ..... 81/177.2, 177.75, 124.2, 438
See application file for complete search history.

(56) References Cited

U.S. PATENT DOCUMENTS 6,488,452 B1 12/2002 Hoskins et al.
6,698,319 B2 3/2004 Huang
6,929,266 B2 8/2005 Peters et al.
6,976,411 B1 12/2005 Yu
7,278,342 B1 10/2007 Chang
7,363,839 B2 4/2008 Chiang
7,392,727 B1 7/2008 Chiang
7,481,136 B2 * 1/2009 Chiang ..... 81/177.75
7,669,860 B2 * 3/2010 Chiang ..... 279/143

* cited by examiner

*Primary Examiner* — Lee D Wilson
*Assistant Examiner* — Danny Hong
(74) *Attorney, Agent, or Firm* — Charles E. Baxley

(57) ABSTRACT

A tool extension includes a positioning ring engaged with a housing, a detent extendible into a bore of the housing, a shank attached to the housing for supporting a tool element, a shaft engaged in the housing and having two or more outer peripheral grooves for engaging with the detent, and a control device having a sleeve and a control ferrule secured together and engaged onto the housing, and two spring biasing members engaged with the positioning ring and the sleeve and the control ferrule, and the control ferrule includes two troughs for engaging with the detent and for defining an inner peripheral actuator between the troughs and for easily operating the sleeve and the control ferrule of the control device.

8 Claims, 5 Drawing Sheets

TOOL EXTENSION

BACKGROUND OF THE INVENTION

1. Field of the Invention

The present invention relates to a combination tool or tool extension, and more particularly to a combination tool or tool combination or tool extension including a structure for easily and quickly and readily and safely attaching or mounting or securing a tool stem to an outer covering or housing and for adjusting the tool stem relative to the outer covering or housing to the required extending position or location, and for allowing the tool extension to be easily and suitably actuated or operated by the user.

2. Description of the Prior Art

Typical combination tools or tool combinations or tool extensions comprise two or more tool members or tool elements adjustably secured or coupled together to form a retractable or telescopic structure and for allowing the tool extensions to secure or couple a driven tool member to the driving tools, such as the tool handles, or hydraulic or pneumatic driving mechanisms or facilities or the like, and for allowing the driven tool member to be suitably rotated or driven by the driving tools.

For example, U.S. Pat. No. 6,488,452 to Hoskins et al., U.S. Pat. No. 6,698,319 to Huang, U.S. Pat. No. 6,929,266 to Peters et al., U.S. Pat. No. 6,976,411 to Yu, U.S. Pat. No. 7,278,342 to Chang, U.S. Pat. No. 7,363,839 to Chiang, U.S. Pat. No. 7,392,727 to Chiang, U.S. Pat. No. 7,481,136 to Chiang, and U.S. Pat. No. 7,669,860 to Chiang disclose several of the typical combination tools or tool extensions each also comprising two or more tool members or tool elements adjustably secured or coupled together to form a retractable or telescopic structure and to be adjusted to different length or the like, and for attaching or mounting or securing or coupling to various driving tools and for allowing the tool extensions to be selectively rotated and driven by the driving tools.

However, the typical combination tools or tool extensions comprise a control ferrule that may be moved in only one active direction relative to the tool extension to adjustably secure or couple the tool members or tool elements together, but the control ferrule may not be moved in the other direction relative to the tool extension to adjustably secure or couple the tool members or tool elements together, such that the typical combination tools or tool extensions may not be easily and suitably and effectively actuated or operated by the user, particularly when the typical combination tools or tool extensions are required to be attached or mounted or secured or coupled to the driving tools with the hands of the user, such as the tool handles, or hydraulic or pneumatic driving mechanisms or facilities or the like.

The present invention has arisen to mitigate and/or obviate the afore-described disadvantages of the conventional combination tools or tool extensions.

SUMMARY OF THE INVENTION

The primary objective of the present invention is to provide a combination tool or tool extension including a structure for easily and quickly and readily and safely attaching or mounting or securing a tool stem to an outer covering or housing and for adjusting the tool stem relative to the outer covering or housing to the required extending position or location, and for allowing the tool extension to be easily and suitably actuated or operated by the user.

In accordance with one aspect of the invention, there is provided a tool extension comprising a housing including a longitudinal bore formed therein and having a non-circular cross section, and the housing including a first end portion and a second end portion, and including a peripheral slot formed in an intermediate portion of the housing, and the housing including an opening formed therein and located close to the first end portion of the housing, a positioning ring engaged with the peripheral slot of the housing and extended radially and outwardly from the housing, a detent slidably received and engaged in the opening of the housing and partially extendible into the longitudinal bore of the housing, a fetching device including a shank having a non-circular projection extended therefrom for engaging with the bore at the second end portion of the housing and for allowing the shank to be rotated by the housing, and the shank including a non-circular engaging hole formed therein for engaging with a tool element and for allowing the tool element to be selectively rotated and driven by the shank and the housing, a shaft slidably received and engaged in the bore of the housing, and including a non-circular cross section for engaging with the non-circular bore of the housing and for guiding the shaft to slide axially relative to the housing only, and for preventing the shaft from being rotated relative to the housing, and for allowing the shaft to be rotated by the housing, the shaft including a stem extended therefrom for coupling to a driving tool, and the shaft including a first outer peripheral groove and at least one second outer peripheral groove formed therein for selectively engaging with the detent and for adjustably positioning the shaft to the housing at selected positions, and a control device attached to the housing for selectively engaging with the detent and for actuating the detent to selectively engage with the shaft and to lock the shaft to the housing at the selected positions, the control device including a sleeve having a chamber formed therein for receiving and engaging with the housing, the sleeve including a peripheral flange extended radially and inwardly from a first end portion of the sleeve, and a first spring biasing member engaged onto the housing and received in the chamber of the sleeve and engaged between the peripheral flange of the sleeve and the positioning ring for biasing and forcing the sleeve to move away from the positioning ring and the detent and to move toward the second end portion of the housing, a control ferrule having a compartment formed therein for receiving and engaging with the housing, the control ferrule being secured to the sleeve and moved in concert with the sleeve, the control ferrule including an inner peripheral flange rib extended radially and inwardly into the compartment of the control ferrule, a second spring biasing member engaged onto the housing and received in the compartment of the control ferrule and engaged between the inner peripheral rib of the control ferrule and the positioning ring for biasing and forcing the control ferrule to move away from the positioning ring and the second end portion of the housing and to move toward the first end portion of the housing, the control ferrule including a first trough and a second trough formed therein and spaced from each other for selectively receiving and engaging with the detent and for defining an inner peripheral actuator between the troughs of the control ferrule, the actuator being selectively engageable with the detent for actuating the detent to selectively engage with either of the first or the second peripheral grooves of the shaft and to lock the shaft to the housing at the selected positions, the actuator being biased and forced to engage with the detent by the first and the second spring biasing members when the sleeve and the control ferrule are released, and the detent is selectively received and engaged in the first trough of the control ferrule and disengaged and separated from the actuator of the control ferrule and disengaged and separated from the shaft when the sleeve and the control ferrule of the control device are moved away from the first end portion of the housing, for allowing the shaft to be moved and adjusted relative to the housing to the selected positions, and the actuator of the control ferrule being biased and forced to engage with the detent again and to force the detent to engage with either of the first or the second peripheral grooves of the shaft when the sleeve and the control ferrule of the control device are released, and the detent is selectively received and engaged in the second trough of the control ferrule and disengaged and separated from the actuator of the control ferrule and disengaged and separated from the shaft when the sleeve and the control ferrule of the control device are moved away from the second end portion of the housing, for allowing the shaft to be moved and adjusted relative to the housing to the selected positions, and the actuator of the control ferrule may be biased and forced to engage with the detent again and to force the detent to engage with either of the first or the second peripheral grooves of the shaft when the sleeve and the control ferrule of the control device are released by the user, for allowing the tool extension to be easily and suitably actuated or operated by the user.

The sleeve includes an inner thread formed therein, and the control ferrule includes an outer thread formed thereon for threading and engaging with the inner thread of the sleeve and for threading and securing the control ferrule to the sleeve. The sleeve may also be secured or coupled to the control ferrule with latches or fasteners or quick release couplers or the like without the threading engagement.

The control device includes a sealing ring engaged onto the housing and engaged with the positioning ring and the first spring biasing member, and the control device includes another sealing ring engaged onto the housing and engaged with the positioning ring and the second spring biasing member for allowing the sleeve and the control ferrule to be moved in either direction relative to the housing.

The shaft includes a retaining ring attached thereto and slightly extended radially and outwardly from the shaft for selectively engaging with the detent and for frictionally engaging with the inner peripheral surface of the housing and for limiting the shaft to slide relative to the housing and for preventing the shaft from being disengaged from the housing.

The shank includes a tilted or inclined or slant channel formed therein and communicating with the engaging hole of the shank, a third spring biasing member is engaged onto the shank and has an end segment engaged into the channel of the shank for selectively engaging with the tool element and for resiliently coupling the tool element to the shank.

The fetching device includes a barrel slidably engaged onto the shank, and the barrel includes a space formed therein for receiving and engaging with the shank, and includes an inner peripheral rib extended into the space thereof for engaging with the third spring biasing member and for anchoring the third spring biasing member in the barrel.

The fetching device includes a gasket engaged into the barrel for engaging with the third spring biasing member and for retaining the third spring biasing member in the barrel and for preventing the third spring biasing member from being disengaged from the barrel, and also for further preventing the barrel from being disengaged from the shank.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
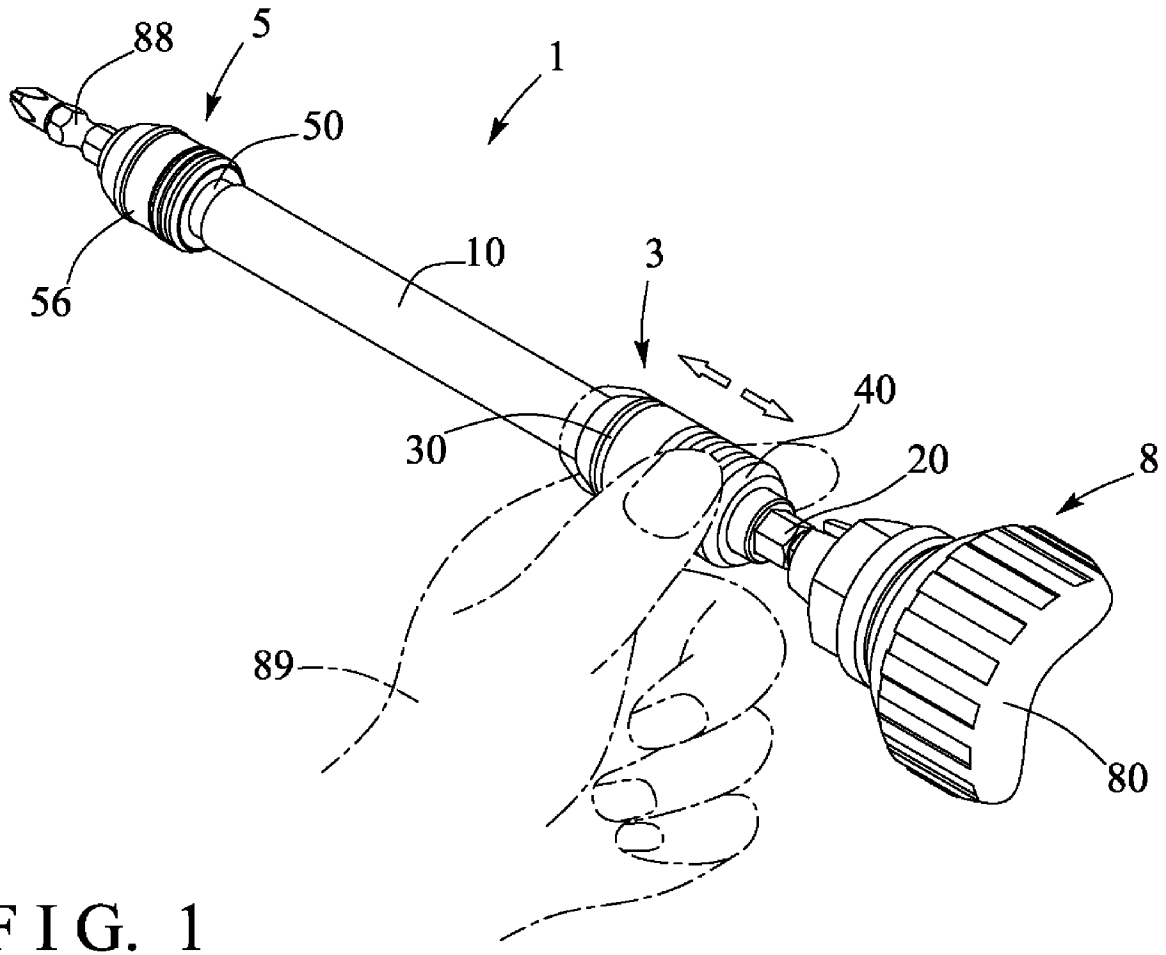
FIG. 1 is a partial perspective view of a combination tool or tool extension in accordance with the present invention for attaching or mounting or securing to a driving tool.
Figure 2:
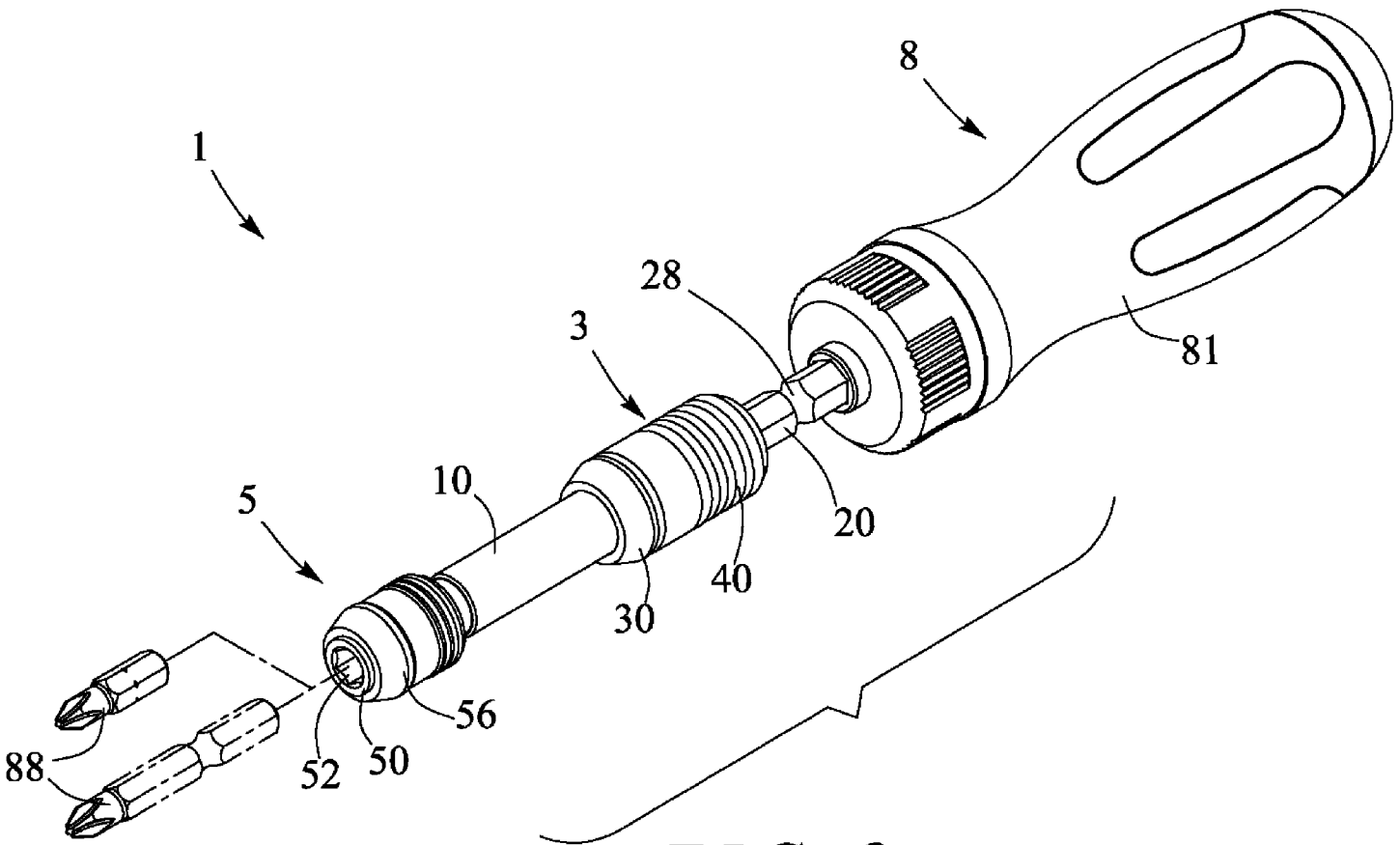
FIG. 2 is a partial exploded view illustrating the operation of the combination tool or tool extension.
Figure 3:
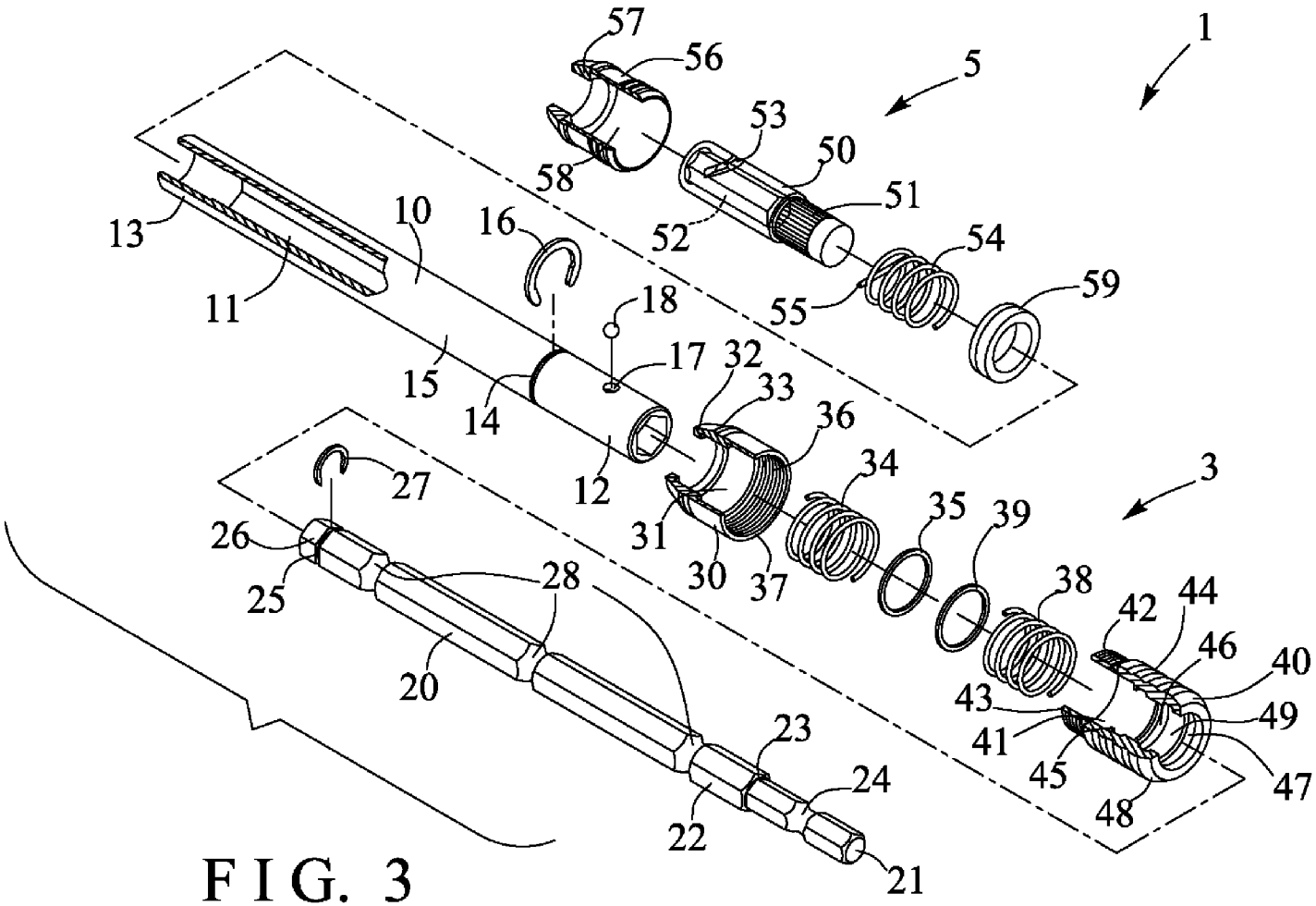
FIG. 3 is an exploded view of the combination tool or tool extension.

Referring to the drawings, and initially to FIGS. 1 and 2, a combination tool or tool extension 1 in accordance with the present invention is developed and provided for attaching or mounting or securing or coupling to a driving tool 8, such as the hydraulic or pneumatic driving mechanisms or facilities 80 (FIG. 1), the tool handles 81 (FIG. 2), or the like in order to be suitably rotated or driven by the driving tool 8. Referring next to FIGS. 3-4 and again to FIGS. 1 and 2, the tool extension 1 comprises a longitudinal arm or handle or tubular or cylindrical member or housing 10 including a longitudinal chamber or compartment or bore 11 formed therein, such as formed through the length thereof and having a non-circular cross section, and the housing 10 includes one end or first end portion 12 and the other or the second end portion 13.

Figure 4:
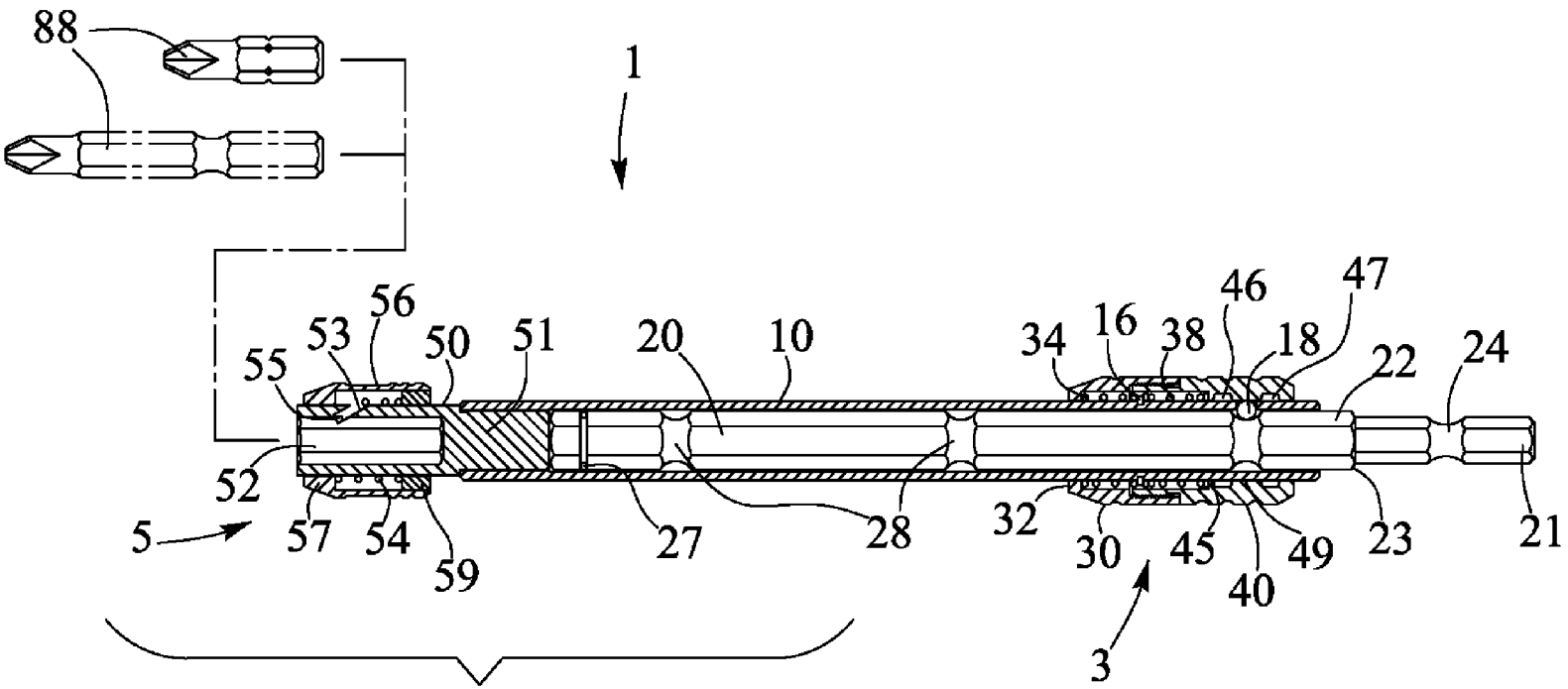
FIG. 4 is a partial exploded and partial cross sectional view of the combination tool or tool extension.
Figure 5:
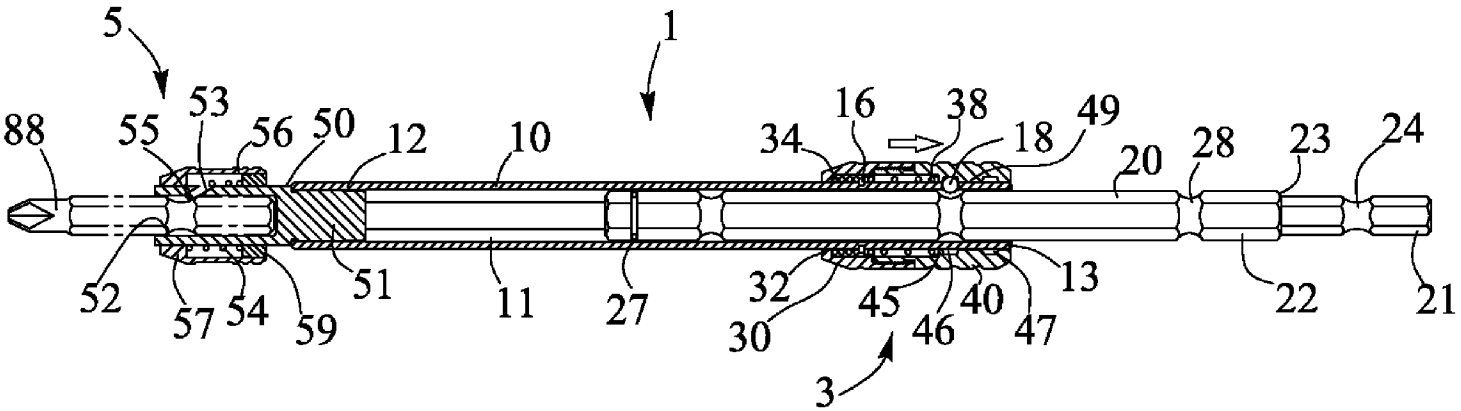
FIGS. 5 and 6 are partial cross sectional views illustrating the operation of the combination tool or tool extension.
Figure 6:
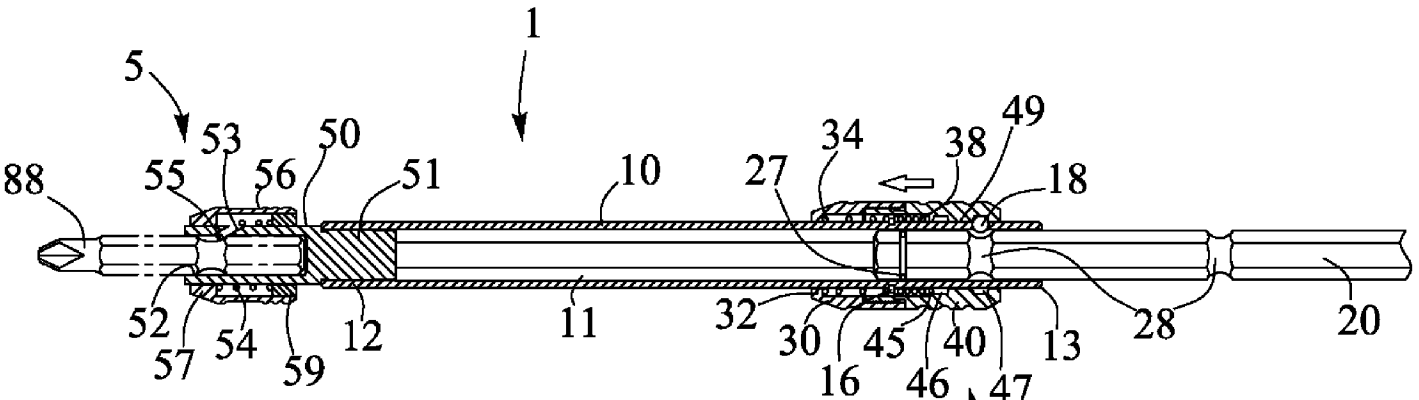

The housing 10 further includes a peripheral slot 14 formed in the outer peripheral portion thereof and located at the middle or intermediate portion 15 thereof for receiving or engaging with a clamping or retaining or positioning ring 16 and arranged for allowing the positioning ring 16 to be slightly extended radially and outwardly from the housing 10, best shown in FIGS. 4-6, and the housing 10 further includes an orifice or aperture or opening 17 formed therein and located close to the one end or first end portion 12 thereof for slidably receiving or engaging with a projection or pawl or detent 18 which is partially extendible or engageable into the longitudinal bore 11 of the housing 10, also best shown in FIGS. 4-6, and the detent 18 is also partially and selectively extendible out of the housing 10.

A longitudinal extension or lever or shank or shaft 20 is slidably received or engaged in the longitudinal bore 11 of the housing 10, and includes a non-circular cross section for engaging with the corresponding non-circular cross section of the longitudinal bore 11 of the housing 10 for guiding the shaft 20 to slide axially relative to the housing 10 only, and for preventing the shaft 20 from being pivoted or rotated relative to the housing 10, and for allowing the shaft 20 to be suitably and selectively pivoted or rotated or driven by or with the housing 10 and by the user. The shaft 20 includes a lever or arm or shaft or stem 21 extended outwardly from one end portion 22 thereof and having an outer diameter or width or size or dimension smaller than that of the shaft 20 for forming or defining an outer peripheral shoulder 23 between the shaft 20 and the stem 21.

The stem 21 includes an outer peripheral recess 24 formed therein for suitably attaching or mounting or securing or coupling the shaft 20 to the driving tool 8, such as the hydraulic or pneumatic driving mechanisms or facilities 80 (FIG. 1), or the tool handles 81 (FIG. 2). The attaching or mounting or securing or coupling of the stem 21 of the shaft 20 to the driving tool 8 is typical and is not related to the present invention and will not be described in further details. The shaft 20 further includes another outer peripheral recess or depression 25 formed therein, such as formed in the other or the second end portion 26 thereof for suitably receiving or engaging with a clamping or anchoring or positioning or retaining ring 27 which is slightly extended radially and outwardly from the shaft 20 for selectively and frictionally engaging with the housing 10 (FIGS. 4-6).

For example, the retaining ring 27 is slightly extended radially and outwardly from the shaft 20 for selectively contacting and engaging with the detent 18 and for limiting the shaft 20 to slide or move relative to the housing 10 and for preventing the shaft 20 from being disengaged or separated from the housing 10, and the shaft 20 further includes one or more (such as three) outer peripheral slots or grooves 28 formed therein for selectively engaging with the detent 18 and for adjustably anchoring or mounting or securing or retaining or positioning the shaft 20 to the housing 10 at selected or required extending positions or locations (FIGS. 4-6). A control device 3 is further provided and attached or mounted or secured or engaged onto the housing 10 for selectively contacting and engaging with the detent 18 and for actuating or operating the detent 18 to selectively engage with the shaft 20 and to lock the shaft 20 to the housing 10 at the selected or required extending positions or locations.

The control device 3 includes a tubular or cylindrical member or sleeve 30 having a bore or compartment or chamber 31 formed therein for pivotally or rotatably and slidably receiving or engaging with the housing 10, and the sleeve 30 includes a peripheral rib or flange 32 extended therein, such as extended radially and inwardly from the one end or first end portion 33 thereof, and a spring biasing member 34 attached or mounted or secured or engaged onto the housing 10 and received or engaged in the chamber 31 of the sleeve 30, and contacted or engaged with or between the peripheral flange 32 of the sleeve 30 and the positioning ring 16 for biasing and forcing the sleeve 30 to move away from the positioning ring 16 and the detent 18 and to move toward the other or the second end portion 13 of the housing 10. A sealing ring 35 may further be provided and attached or mounted or secured or engaged onto the housing 10 and contacted or engaged with the peripheral flange 32 of the sleeve 30 or the positioning ring 16 and contacted or engaged with the spring biasing member 34.

The control device 3 further includes another tubular or cylindrical member or barrel or control ferrule 40 having a bore or chamber or compartment 41 formed therein for pivotally or rotatably and slidably receiving or engaging with the housing 10, and the control ferrule 40 includes an outer thread 42 formed or provided on one end or first end portion 43 thereof for threading or engaging with the inner thread 36 that is formed in the other or the second end portion 37 of the sleeve 30 and for solidly and stably attaching or mounting or securing or coupling the control ferrule 40 to the sleeve 30 and for allowing the sleeve 30 and the control ferrule 40 to be moved in concert with each other relative to the housing 10. Alternatively, the sleeve 30 and the control ferrule 40 may also be secured or coupled together with latches or fasteners or quick release couplers (not shown) or the like without the threading engagement 36, 42.

The control ferrule 40 includes a middle or intermediate portion 44 having an inner peripheral flange or rib 45 extended radially and inwardly therefrom, or extended into the compartment 41 thereof. Another spring biasing member 38 is further provided and attached or mounted or secured or engaged onto the housing 10 and received or engaged in the compartment 41 of the control ferrule 40, and contacted or engaged with or between the inner peripheral rib 45 of the control ferrule 40 and the positioning ring 16 for biasing and forcing the control ferrule 40 to move away from the positioning ring 16 and the other or the second end portion 13 of the housing 10, and to move toward the one end or first end portion 12 of the housing 10. Another sealing ring 39 may further be provided and attached or mounted or secured or engaged onto the housing 10 and contacted or engaged with the inner peripheral rib 45 of the control ferrule 40 or the positioning ring 16 and contacted or engaged with the spring biasing member 38.

The control ferrule 40 further includes two inner peripheral troughs 46, 47 formed therein, such as formed in the other or the second end portion 48 thereof and spaced from each other for selectively receiving or engaging with the detent 18 and for forming or defining an inner peripheral bulge or protrusion or member or actuator 49 between the troughs 46, 47 of the control ferrule 40, in which the actuator 49 is selectively contactable or engageable with the detent 18 for selectively actuating or forcing or moving the detent 18 to engage with either of the peripheral grooves 28 of the shaft 20 (FIG. 4) and thus to selectively lock the shaft 20 to the housing 10 at the selected or required extending positions or locations. The actuator 49 may be biased and forced and moved to engage with the detent 18 by the spring biasing members 34, 38 when the sleeve 30 and the control ferrule 40 are released.

A tool gripping or grasping or fetching device 5 is further provided and attached or mounted or secured or engaged onto the housing 10 for selectively contacting and engaging with and gripping or grasping or fetching the fasteners or tool members or tool elements 88 to the housing 10. For example, the fetching device 5 includes a lever or shaft or shank 50 having a non-circular or serrated extension or end portion or projection 51 extended therefrom for engaging with or into the corresponding non-circular bore 11 at the other or the second end portion 13 of the housing 10 and for allowing the shank 50 to be suitably and selectively pivoted or rotated or driven by or with the housing 10, and the shank 50 includes a non-circular orifice or aperture or opening or space or cavity or engaging hole 52 formed therein for selectively receiving or engaging with the fasteners or tool members or tool elements 88 therein (FIGS. 5, 6) and thus for allowing the tool elements 88 to be selectively pivoted or rotated or driven by or with the shank 50 and the housing 10.

The shank 50 further includes a tilted or inclined or slant channel 53 formed therein and communicating with the engaging hole 52 of the shank 50. The fetching device 5 further includes a spring biasing member 54 provided and attached or mounted or secured or engaged onto the shank 50, and the spring biasing member 54 includes a spring or resilient end portion or end segment 55 engaged into the slant channel 53 of the shank 50 for selectively engaging with the fasteners or tool members or tool elements 88 and for resiliently anchoring or retaining or positioning the tool element 88 to the shank 50. The fetching device 5 further includes a tubular or cylindrical member or control ferrule or sleeve or barrel 56 slidably attached or mounted or engaged onto the shank 50, and the barrel 56 includes a bore or chamber or compartment or space 58 formed therein for pivotally or rotatably and slidably receiving or engaging with the shank 50.

The barrel 56 further includes an inner peripheral flange or rib 57 extended radially and inwardly therefrom, or extended into the space 58 thereof for engaging with the spring biasing member 54 and for anchoring or retaining or positioning the spring biasing member 54 in the barrel 56, and a sealing ring or washer or gasket 59 is further provided and attached or mounted or engaged into the barrel 56 for engaging with the spring biasing member 54 and for further solidly and stably anchoring or retaining or positioning the spring biasing member 54 in the barrel 56, and for preventing the spring biasing member 54 from being disengaged or separated from the barrel 56, and also for preventing the barrel 56 from being disengaged or separated from the shank 50.

In operation, as shown in FIGS. 4-6, the selected or required fasteners or tool members or tool elements 88 may be selectively attached or mounted or engaged into the engaging hole 52 of the shank 50, and the spring or resilient end portion or end segment 55 of the spring biasing member 54 may be engaged into the slant channel 53 of the shank 50 for selectively engaging with the tool elements 88 and for resiliently anchoring or retaining or positioning the tool elements 88 to the shank 50 and for allowing the tool elements 88 to be solidly and stably and suitably pivoted or rotated or driven by the shank 50 and the housing 10. The stem 21 and/or the shaft 20 may be selectively attached or mounted or engaged or coupled to the driving tool 8, such as the hydraulic or pneumatic driving mechanisms or facilities 80 (FIG. 1), or the tool handles 81 (FIG. 2) for allowing the tool elements 88 and the shank 50 and the housing 10 and the shaft 20 to be suitably rotated or driven by the driving tool 8.

Further in operation, as shown in FIG. 4, when the sleeve 30 and the control ferrule 40 of the control device 3 are released by the user, the spring biasing members 34, 38 may bias and force and move the actuator 49 to engage with the detent 18, and may bias and force and move the detent 18 to engage with either of the peripheral grooves 28 of the shaft 20 and thus to solidly and stably and selectively lock the shaft 20 to the housing 10 at the selected or required extending positions or locations. As shown in FIG. 5, when the sleeve 30 and the control ferrule 40 of the control device 3 are moved toward the other or the second end portion 13 of the housing 10, or moved away from the one end or first end portion 12 of the housing 10, the actuator 49 of the control ferrule 40 may be removed or disengaged or separated from the detent 18 for allowing the detent 18 to be selectively received or engaged in either of the troughs 46, 47 of the control ferrule 40.

For example, the detent 18 may be selectively received or engaged in the trough 46 of the control ferrule 40 and may be removed or disengaged or separated from the shaft 20 for allowing the shaft 20 to be moved or adjusted along or relative to the housing 10 to the selected or required extending positions or locations until the other peripheral grooves 28 of the shaft 20 are aligned with the detent 18 again, and the actuator 49 of the control ferrule 40 may be biased and forced and moved to engage with the detent 18 again and to force and move the detent 18 to engage with the other peripheral grooves 28 of the shaft 20 and thus to solidly and stably and selectively lock the shaft 20 to the housing 10 at the other selected or required extending positions or locations when the sleeve 30 and the control ferrule 40 of the control device 3 are released by the user again.

As shown in FIG. 6, when the sleeve 30 and the control ferrule 40 of the control device 3 are moved toward the other direction; i.e., moved toward the one end or first end portion 12 of the housing 10, or moved away from the other or the second end portion 13 of the housing 10, the actuator 49 of the control ferrule 40 may also be removed or disengaged or separated from the detent 18 for allowing the detent 18 to be selectively received or engaged in the other trough 47 of the control ferrule 40 and to be removed or disengaged or separated from the shaft 20 for allowing the shaft 20 to be moved or adjusted along or relative to the housing 10 to the other selected or required extending positions or locations again until the other peripheral grooves 28 of the shaft 20 are aligned with the detent 18 again, and the actuator 49 of the control ferrule 40 may be biased and forced and moved to engage with the detent 18 again when the sleeve 30 and the control ferrule 40 of the control device 3 are released by the user again.

It is to be noted that, when in operation, as shown in FIGS. 1 and 2, the user or the worker have to use one of his hands to hold and grasp the driving mechanism or facility 80 or the tool handle 81, and may have to use the other hand 89 (FIG. 1) to hold and grasp and actuate or operate or move the sleeve 30 and the control ferrule 40 of the control device 3 relative to the housing 10, and the provision and the engagement of the spring biasing members 34, 38 with the positioning ring 16 allow the sleeve 30 and the control ferrule 40 of the control device 3 to be easily and quickly and readily and effectively and suitably actuated or operated or moved by the user with the other hand and the single hand 89 of the user or the worker.

Accordingly, the combination tool or tool extension in accordance with the present invention includes a structure for easily and quickly and readily and safely attaching or mounting or securing a tool stem to an outer covering or housing and for adjusting the tool stem relative to the outer covering or housing to the required extending position or location, and for allowing the tool extension to be easily and suitably actuated or operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool extension comprising:

a housing including a longitudinal bore formed therein and having a non-circular cross section, and said housing including a first end portion and a second end portion, and including a peripheral slot formed in an intermediate portion of said housing, and said housing including an opening formed therein and located close to said first end portion of said housing, a positioning ring engaged with said peripheral slot of said housing and extended radially and outwardly from said housing, a detent slidably received and engaged in said opening of said housing and partially extendible into said longitudinal bore of said housing, a fetching device including a shank having a non-circular projection extended therefrom for engaging with said bore at said second end portion of said housing and for allowing said shank to be rotated by said housing, and said shank including a non-circular engaging hole formed therein for engaging with a tool element and for allowing said tool element to be selectively rotated and driven by said shank and said housing, a shaft slidably received and engaged in said bore of said housing, and including a non-circular cross section for engaging with said non-circular bore of said housing and for guiding said shaft to slide axially relative to said housing only, and for preventing said shaft from being rotated relative to said housing, and for allowing said shaft to be rotated by said housing, said shaft including a stem extended therefrom for coupling to a driving tool, and said shaft including a first outer peripheral groove and at least one second outer peripheral groove formed therein for selectively engaging with said detent and for adjustably positioning said shaft to said housing at selected positions, and a control device attached to said housing for selectively engaging with said detent and for actuating said detent to selectively engage with said shaft and to lock said shaft to said housing at the selected positions, said control device including a sleeve having a chamber formed therein for receiving and engaging with said housing, said sleeve including a peripheral flange extended radially and inwardly from a first end portion of said sleeve, and a first spring biasing member engaged onto said housing and received in said chamber of said sleeve and engaged between said peripheral flange of said sleeve and said positioning ring for biasing and forcing said sleeve to move away from said positioning ring and said detent and to move toward said second end portion of said housing, a control ferrule having a compartment formed therein for receiving and engaging with said housing, said control ferrule being secured to said sleeve and moved in concert with said sleeve, said control ferrule including an inner peripheral flange rib extended radially and inwardly into said compartment of said control ferrule, a second spring biasing member engaged onto said housing and received in said compartment of said control ferrule and engaged between said inner peripheral rib of said control ferrule and said positioning ring for biasing and forcing said control ferrule to move away from said positioning ring and said second end portion of said housing and to move toward said first end portion of said housing, said control ferrule including a first trough and a second trough formed therein and spaced from each other for selectively receiving and engaging with said detent and for defining an inner peripheral actuator between said troughs of said control ferrule, said actuator being selectively engageable with said detent for actuating said detent to selectively engage with either of said first or said at least one second peripheral grooves of said shaft and to lock said shaft to said housing at the selected positions, said actuator being biased and forced to engage with said detent by said first and said second spring biasing members when said sleeve and said control ferrule are released, and said detent being selectively received and engaged in said first trough of said control ferrule and disengaged and separated from said actuator of said control ferrule and disengaged and separated from said shaft when said sleeve and said control ferrule of said control device are moved away from said first end portion of said housing, for allowing said shaft to be moved and adjusted relative to said housing to the selected positions, and said actuator of said control ferrule being biased and forced to engage with said detent again and to force said detent to engage with either of said first or said at least one second peripheral grooves of said shaft when said sleeve and said control ferrule of said control device are released, and said detent being selectively received and engaged in said second trough of said control ferrule and disengaged and separated from said actuator of said control ferrule and disengaged and separated from said shaft when said sleeve and said control ferrule of said control device are moved away from said second end portion of said housing, for allowing said shaft to be moved and adjusted relative to said housing to the selected positions, and said actuator of said control ferrule being biased and forced to engage with said detent again and to force said detent to engage with either of said first or said at least one second peripheral grooves of said shaft when said sleeve and said control ferrule of said control device are released.

2. The tool extension as claimed in claim 1, wherein said sleeve includes an inner thread formed therein, and said control ferrule includes an outer thread formed thereon for threading and engaging with said inner thread of said sleeve and for securing said control ferrule to said sleeve.

3. The tool extension as claimed in claim 1, wherein said control device includes a sealing ring engaged onto said housing and engaged with said positioning ring and said first spring biasing member.

4. The tool extension as claimed in claim 1, wherein said control device includes a sealing ring engaged onto said housing and engaged with said positioning ring and said second spring biasing member.

5. The tool extension as claimed in claim 1, wherein said shaft includes a retaining ring attached thereto and slightly extended radially and outwardly from said shaft for selectively engaging with said detent and for limiting said shaft to slide relative to said housing and for preventing said shaft from being disengaged from said housing.

6. The tool extension as claimed in claim 1, wherein said shank includes a channel formed therein and communicating with said engaging hole of said shank, a third spring biasing member engaged onto said shank and having an end segment engaged into said channel of said shank for selectively engaging with said tool element.

7. The tool extension as claimed in claim 6, wherein said fetching device includes a barrel slidably engaged onto said shank, and said barrel includes a space formed therein for receiving and engaging with said shank, and includes an inner peripheral rib extended into said space thereof for engaging with said third spring biasing member and for anchoring said third spring biasing member in said barrel.

8. The tool extension as claimed in claim 7, wherein said fetching device includes a gasket engaged into said barrel for engaging with said third spring biasing member and for retaining said third spring biasing member in said barrel and for preventing said third spring biasing member from being disengaged from said barrel, and for preventing said barrel from being disengaged from said shank.

* * * * *